US006688055B2

(12) United States Patent
Lindsley

(10) Patent No.: US 6,688,055 B2
(45) Date of Patent: Feb. 10, 2004

(54) SPIRAL INCREMENTAL STRUCTURE AND METHOD OF CONSTRUCTION

(76) Inventor: James A. Lindsley, 2106 Morreene Rd., Durham, NC (US) 27701

( * ) Notice: Subject to any disclaimer, the term of this patent is extended or adjusted under 35 U.S.C. 154(b) by 0 days.

(21) Appl. No.: 10/085,660

(22) Filed: Feb. 26, 2002

(65) Prior Publication Data

US 2002/0116879 A1 Aug. 29, 2002

Related U.S. Application Data

(60) Provisional application No. 60/271,220, filed on Feb. 26, 2001.

(51) Int. Cl.[7] ..... E04H 1/00

(52) U.S. Cl. ..... 52/236.4; 52/79.1; 52/79.3; 52/745.02; 52/745.03; 52/745.13; 52/236.3; 52/234

(58) Field of Search ..... 52/79.1, 79.3, 52/745.02, 745.03, 745.13, 79.14, 236.3, 236.4, 234

(56) References Cited

U.S. PATENT DOCUMENTS

D206,869 S * 2/1967 Hoke, Jr. et al. ..... D25/5

4,633,641 A * 1/1987 Heinbuchner ..... 52/745.03

* cited by examiner

*Primary Examiner*—Carl D. Friedman
*Assistant Examiner*—Steve Varner
(74) *Attorney, Agent, or Firm*—Clifford F. Rey

(57) ABSTRACT

A multilevel spiral incremental structure and construction method for residential and/or commercial buildings is disclosed. The present structure is constructed using a plurality of prefabricated modular units or pods which are substantially similar in their size and configuration and assembled symmetrically about a central core designed to contain ductwork, conduit, vents, pipes and other utility apparatus. The pods are supported on stepped foundation piers at progressively higher elevations based upon a calculated vertical increment factor. In a preferred embodiment six pods are arranged about a central core to produce a hexagonal structure resulting in a vertical increase of about ten feet or one story in floor elevation per revolution about the core. The present construction may be cost effectively expanded into a multilevel building by adding new pods after the initial construction phase without digging a new foundation or demolishing portions of the original structure.

18 Claims, 5 Drawing Sheets

SPIRAL INCREMENTAL STRUCTURE AND METHOD OF CONSTRUCTION

CROSS-REFERENCE TO RELATED APPLICATION

This Application claims the benefit under 35 U.S.C. 119(e) of U.S. Provisional Application No. 60/271,220 filed Feb. 26, 2001 by James A. Lindsley for Spiral Incremental Structure and Method of Construction.

FIELD OF INVENTION

The present invention relates to building construction methods and, more particularly, to a spiral incremental structure for residential and commercial buildings and the method of its construction.

BACKGROUND OF THE INVENTION

Modular building construction and the use of modular building components is well known in the prior art. Many previous efforts have been directed to achieving functional designs that provide for an appearance of angularity in building construction, that is, where the building footprint and room layout are dominated by something other than 90 degree corners. Such prior art designs have commonly used hexagonal units or modules in their construction. The hexagonal modules found in such prior art patents generally stand alone or combine multiple hexagons to create a honeycomb effect.

However, none of these prior art structures succeed in achieving substantial versatility and/or reasonable cost savings over on-site construction. One disadvantage of such modular constructions is the incorporation of building details, technologies, and construction methods that are not easily adapted to manufacturers that currently construct, pre-cut, panelized and modular buildings.

Still other prior art constructions reduce the hexagonal form to a more basic building module: the equilateral triangle. With such triangular systems the previously described cost and versatility problems still exist and, in addition, such triangular schemes also introduce a further problem when using common building materials. For example, commonly sold rectangular floor and roof materials fit very awkwardly into a triangular module.

Further, none of the prior art systems has achieved a cost effective means of making additions to the basic structure without the necessity of digging new foundations, demolition of portions of the original structure and landscape restoration after the addition is completed.

Thus, the present invention has been developed to resolve these problems and other shortcomings of the prior art.

SUMMARY OF THE INVENTION

Accordingly, the present invention provides a spiral incremental structure and construction method by which residential and/or commercial buildings can be built in a hexagonal or other common shape using a plurality of polygonal building sections or so-called pods in their construction. The pods are constructed of prefabricated components, which are substantially similar in their size and configuration, and are assembled symmetrically about a central core designed to contain ductwork, conduit, vents, pipes and other utility apparatus for the building.

A unique feature of the present structure is that the individual pods are supported on stepped foundation piers at progressively higher elevations above ground level. The vertical rise between adjacent pods is referred to as an increment. In a preferred embodiment the arrangement of six pods about a central core to produce an overall hexagonal structure results in an increase of about 10 feet or one story in floor elevation per revolution about the core. This produces a building structure that is generally analogous to a large spiral staircase wherein the floor of each pod is represented by a tread of the staircase. Thus, the present invention is designated a spiral incremental structure for purposes of this application.

A particular advantage of the present construction is that it may be efficiently and cost effectively expanded into a multi-story building by adding new pods at any time after the initial construction phase without digging a new foundation or demolishing portions of the original. This is facilitated by the disassembly of roof sections constructed with removable fasteners and rubber washers, prefabricated roof panels, prefabricated wall sections, prefabricated ceiling/floor joist assemblies, and combination truss/rafters and the reuse of such structural components in the expanded structure.

There has thus been outlined, rather broadly, the important features of the invention in order that the detailed description thereof that follows may be better understood, and in order that the present contribution to the art may be better appreciated.

Those skilled in the art will appreciate that the conception upon which this disclosure is based may readily be utilized as a basis for the designing of other structures, methods, and systems for carrying out the purposes of the present invention. It is important, therefore, that the claims be regarded as including such equivalent constructions insofar as they do not depart from the spirit and scope of the present invention.

Other features and technical advantages of the present invention will become apparent from a study of the following description and the accompanying drawings.

BRIEF DESCRIPTION OF THE DRAWINGS

The novel features of the present invention are set forth in the appended claims. The invention itself, however, as well as other features and advantages thereof will be best understood by reference to the following detailed description of an illustrative embodiment when read in conjunction with the accompanying figures, wherein:

DETAILED DESCRIPTION OF THE PREFERRED EMBODIMENT

Figure 1:
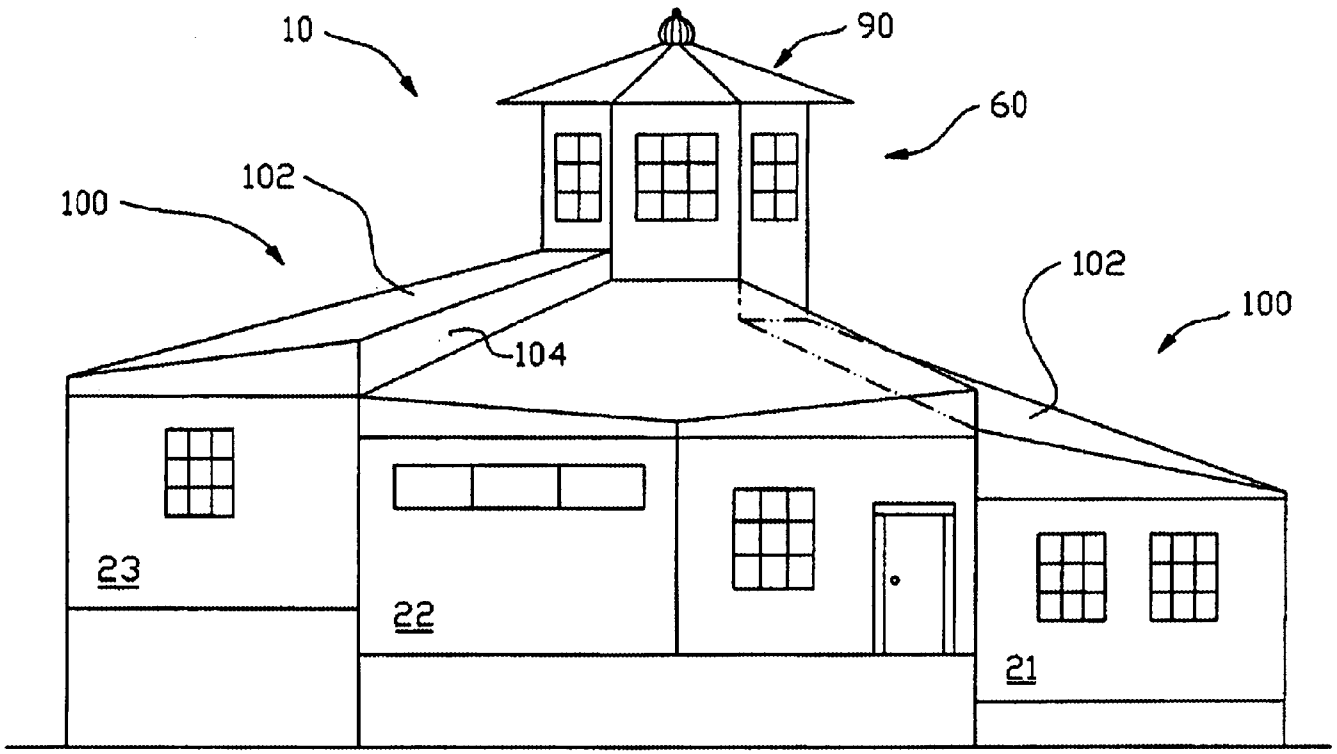
FIG. 1 is an elevational perspective of one embodiment of the spiral incremental structure of the present invention.

With reference to the drawings there is shown therein a view of the spiral incremental structure of the present invention, indicated generally at 10 and illustrated in FIG. 1. This drawing shows the arrangement of individual modules or pods 21–23 about a central, hexagonal core structure 20

(FIG. 3) and exterior details of the present structure 10 including the unique configuration of the roof assembly, indicated generally at 100, including roof panels 102 and roof corner moldings 104. In the embodiment shown in FIG. 1, the central core structure 20 is capped with a cupola or observatory, indicated generally at 60, with a separate hexagonal roof structure, indicated generally at 90 that extends above the main roof assembly 100. It will be appreciated that each of the pods 21–23 is positioned at a progressively higher vertical elevation than the next adjacent pod on a stepped foundation, which is a distinctive characteristic of the present spiral incremental structure 10 as explained hereinafter in further detail.

Figure 2:
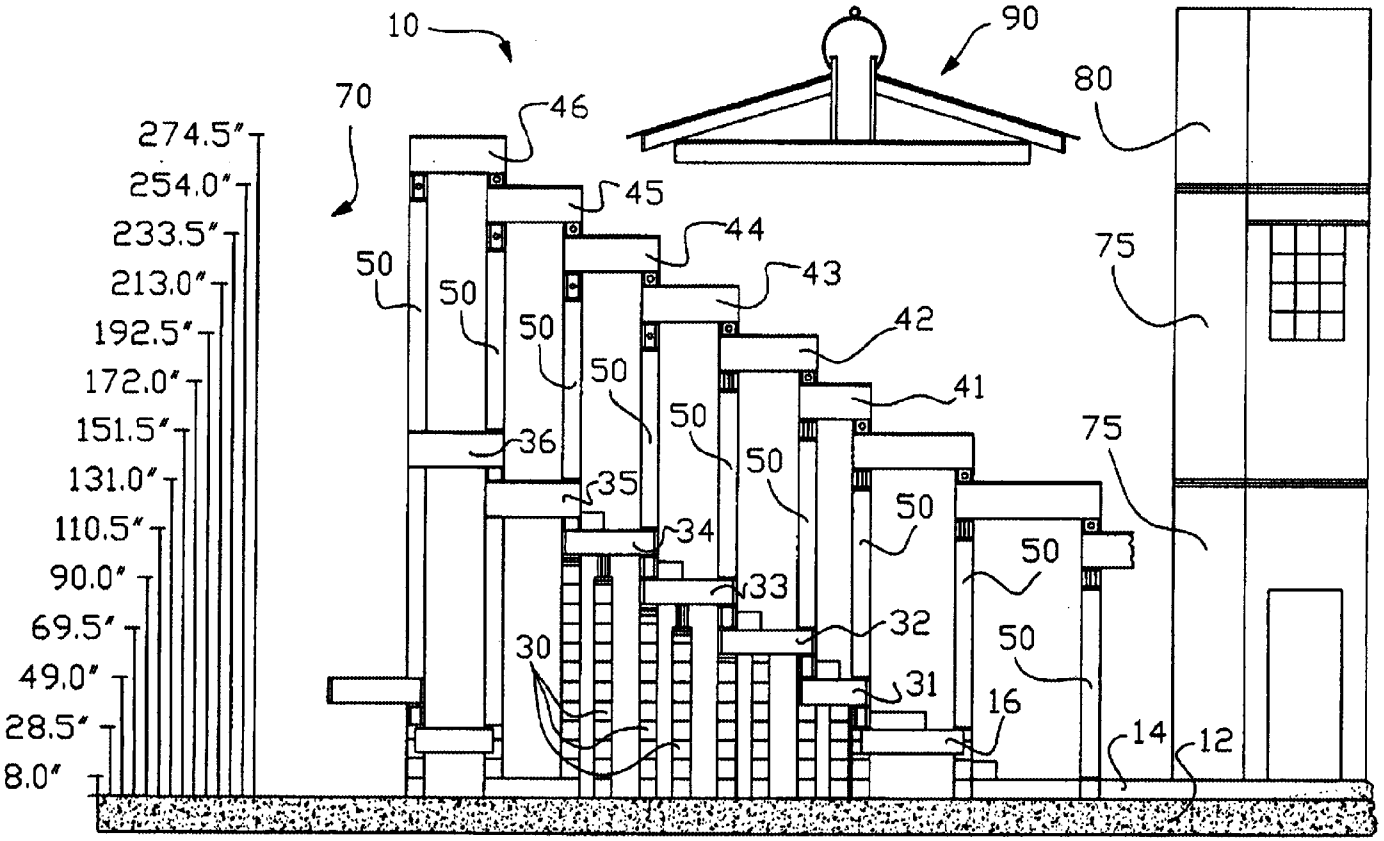
FIG. 2 is a composite elevational projection illustrating construction details of the spiral incremental structure.

The present spiral incremental structure 10 includes innovative supporting means including, but not limited to, the following structures. Referring to FIG. 2 there is shown a composite detail view of the internal supporting elements of the present structure 10. In the embodiment shown, the present structure 10 is supported on a peripheral, concrete footing 12 below grade whereon a concrete basement slab 14 is poured in the conventional manner. The concrete basement slab 14 (see FIG. 3) is generally diamond or kite-shaped with substantially the same dimensions and configuration as an adjacent, concrete garage slab 16 (see FIG. 3) disposed at grade level.

Still referring to FIG. 2 the pods 21–26 are supported in position by a plurality of stepped foundation piers 30 of concrete pillar and/or block construction whereon their respective floor joist assemblies 31–36 are disposed. Each respective ceiling joist assembly 41–46 is disposed in parallel, horizontally opposed relation to its corresponding floor joist assembly 31–36 being supported by inwardly converging, radial wall assemblies 50, which extend from the central core 20 to the exterior wall sections 52.

Figure 4:
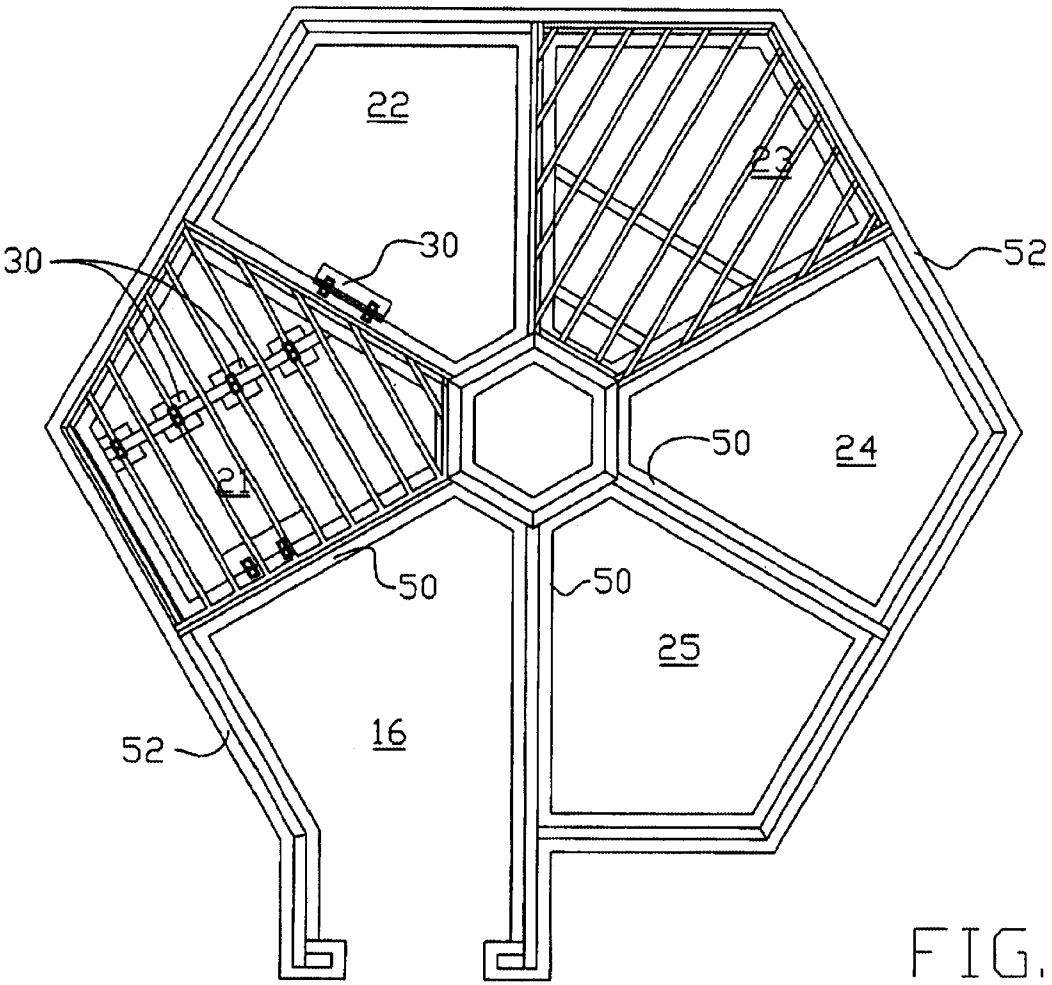
FIG. 4 is a plan view of the spiral incremental structure showing further construction details of the spiral incremental structure.

FIG. 4 illustrates that additional piers 30 may extend radially inward at predetermined locations as necessary to provide added structural support to the radial wall assemblies 50 defining each pod 21–26.

In practice the construction of the spiral incremental structure 10 proceeds after the footing 12, concrete slabs 14 and 16, and the supporting piers 30 are laid and positioned as depicted in FIG. 2. Assembly of the structure 10 proceeds sequentially beginning with the first pod 21 adjacent the garage slab 16 and in the normal practice continues in a clockwise direction as pods 22–26 are added at progressively higher elevations above grade and around the central core 20.

Figure 3:
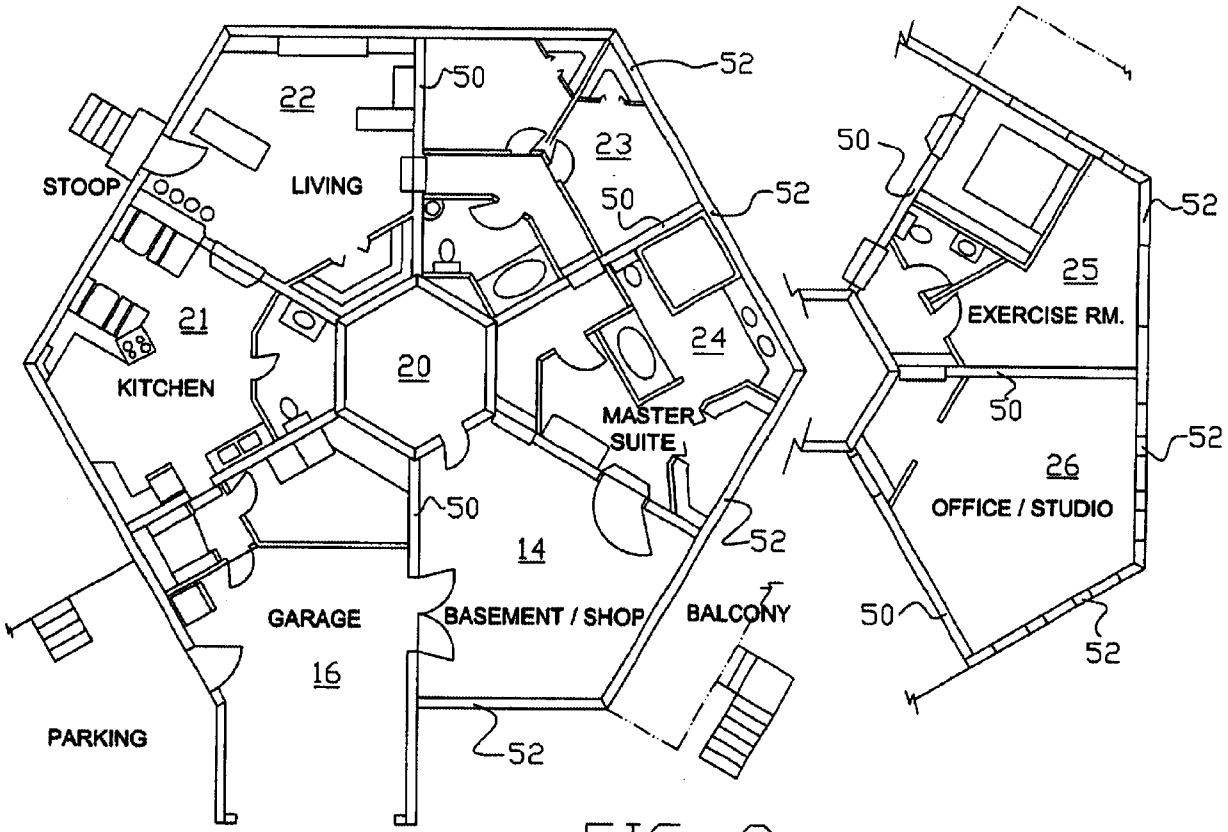
FIG. 3 is a composite plan view of the spiral incremental structure illustrating the arrangement of the individual modules about the central core with floor plan details.

The polygonal modules or so-called pods 21–26 comprising the present structure 10 are arranged in a radially symmetrical pattern about the hexagonal central core 20 as most clearly seen in FIG. 3. It will be appreciated that each of the generally diamond-shaped pods 21–26 defines a designated area or room in the overall structure 10. In the embodiment shown each pod is constructed with inwardly converging walls 50 defining an included angle of 60 degrees such that a total of six pods 21–26 arranged as shown completes a full revolution about the central core structure.

The vertical rise between adjacent pods 21–26 defines the vertical increment for the structure. In the embodiment illustrated the vertical increment between pods corresponds to approximately 20.5 inches as indicated in the vertical elevation scale 70 at the left margin of FIG. 2. This vertical increment factor corresponds approximately to the height of three conventional stair steps or, in the alternative, a handicapped access ramp, which may be disposed between each pod 21–26 if the structure is to be utilized for commercial purposes.

Of course it will be understood that the vertical increment factor may vary in accordance with different designs of the present structure 10, which may include a greater or lesser number of pods in their construction resulting in a different increment.

Referring again to the vertical elevation scale 70 on the left margin of FIG. 2, it will be noted that the difference in elevation from the basement slab 14 (designated Level -L1) to pod 25 (designated Level-L5) is approximately 123 inches or about 10 feet. Thus, in the present embodiment the pod 25 will be disposed directly above the basement slab 14 with approximately 9 feet of ceiling height. In a similar manner the pod 26 (designated Level-L6) is disposed directly above the garage slab 16 (designated Level-L0) with approximately the same 123 inches of clearance providing a 10 foot ceiling height. Construction continues in this manner until the desired number of pods are installed for a given application of the present invention.

In order to add another pod to the spiral incremental structure 10 shown in FIG. 3 after initial construction is completed, the roof panel 100 on pod 21 is disassembled by removal of detachable fasteners such as lag screws, bolts, and rubber washers utilized in the initial construction. Next, new prefabricated radial walls are erected and a new ceiling/floor joist assembly is installed above the radial walls 52. Thereafter, the roof assembly is reinstalled and exterior wall sections are added to complete the structural assembly of the new pod. Some specialty spacers and moldings (not shown) are also required to complete the installation.

It is anticipated that by utilizing prefabricated radial walls, roof panels, exterior wall panels, combination truss/rafters, removable fasteners and a crane, a 420 square foot pod addition can be structurally installed and "dried" within a couple of days. It will be noted that by using the present construction method any number of pods can be added to the present structure 10 until the load capacity of the walls or other restrictions imposed by local building codes is reached.

It will be understood that from time to time additional core units 75 or half core units 80 as shown in FIG. 2 will be added to vertically extend the central core 20 to accommodate additional pods. This is accomplished by removal of the cupola 60 (FIG. 1), adding the necessary core units 75 and/or 80 and then reinstalling the cupola 60 or other core cap structure. In the embodiment shown in FIG. 2, a full core unit 75 is dimensioned to accommodate six vertical increments and a half core unit 80 only 3 vertical increments.

Figure 5:
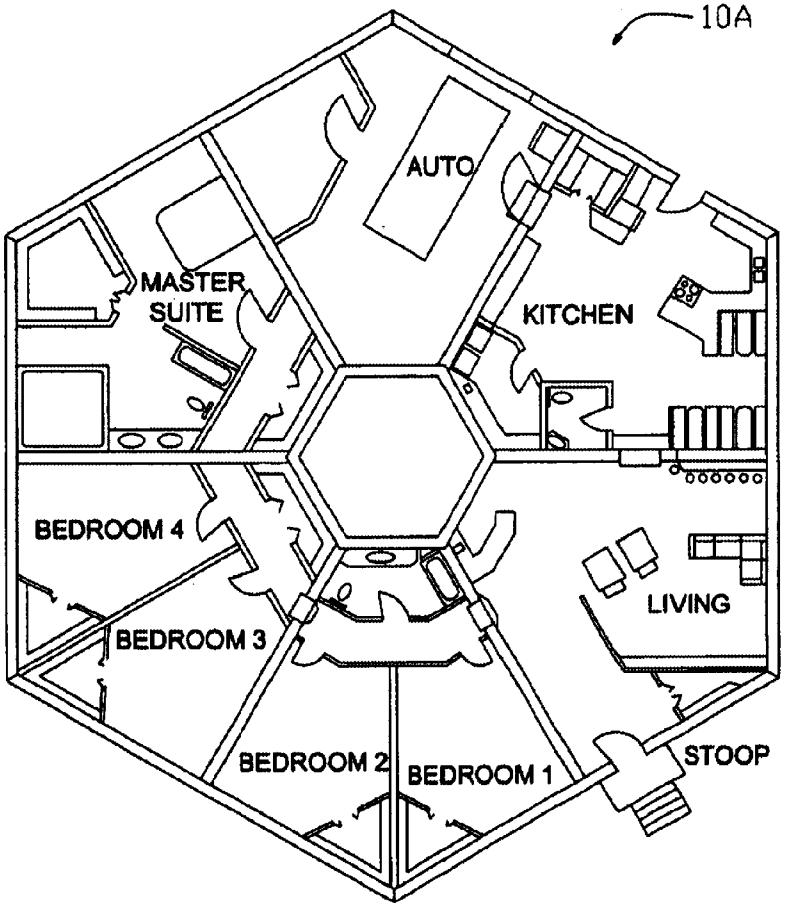
FIG. 5 is an alternative embodiment of the spiral incremental structure showing a modified layout.

Of course numerous other exterior designs and floor plans may be devised within the basic layout of the spiral incremental structure 10. For example, FIG. 5. depicts an alternative embodiment of the present spiral incremental structure, indicated generally at 10' with a modified floor plan.

Although not specifically illustrated in the drawings, it is understood that additional equipment and structural components will be provided as necessary, and that all of the components described above are arranged and supported in an appropriate fashion to form a complete spiral incremental structure incorporating features of the present invention.

It is also understood that variations may be made in the present structure without departing from the spirit and scope of the invention. For example, the present structure may be constructed in accordance with pentagonal, octagonal, or alternative polygonal footprints with substantially different dimensions.

Although illustrative embodiments of the invention have been shown and described, a latitude of modification, change, and substitution is intended in the foregoing disclosure, and in certain instances some features of the invention will be employed without a corresponding use of other features. Accordingly, it is appropriate that the appended claims be construed broadly and in a manner consistent with the scope of invention.

What is claimed is:

1. A spiral incremental structure comprising:

a plurality of pod structures assembled in a radially symmetrical pattern in side-by-side relation about a central core structure, each of said pod structures being positioned at progressively higher elevations based upon a predetermined vertical increment factor in the range of 19.5 to 21.5 inches, wherein said vertical increment factor is calculated to produce a predetermined increase in vertical elevation per revolution about said core structure; and supporting menas installed beneath said pod structures conforming to said progressively higher elevations such that said pod structures will overlap in vertically stacked relation upon construction of a complete revolution about said core structure to form a multilevel spiral structure.

2. The spiral incremental structure of claim 1 wherein said pod structures are prefabricated modules including a floor assembly, radial wall assemblies, an exterior wall assembly, and a roof assembly.

3. The spiral incremental structure of claim 1 wherein said pod structures are generally diamond-shaped in configuration such that said radial wall assemblies within each pod structure define an included angle of 60 degrees.

4. The spiral incremental structure of claim 1 wherein adjacent pod structures are interconnected by removable fastening means.

5. The spiral incremental structure of claim 1 wherein the outer periphery of said structure is hexagonal in configuration.

6. The spiral incremental structure of claim 1 wherein said core structure is hexagonal in configuration.

7. The spiral incremental structure of claim 1 wherein said supporting means includes a stepped foundation wall disposed beneath and extending about the periphery of said spiral incremental structure to support said pod structures at said progressively higher elevations.

8. The spiral incremental structure of claim 7 wherein said supporting means further includes plurality of support columns disposed at predetermined locations conforming to said radially symmetrical pattern and being constructed to said progressively higher elevations to provide support for said pod structures.

9. A spiral incremental structure comprising:

a plurality of prefabricated modules positioned at regular angular intervals around a central core structure, said modules being disposed at progressively higher elevations based upon a predetermined vertical increment factor; and a stepped foundation wall disposed beneath and extending about the periphery of said structure and constructed in conformance with said progressively higher elevations to support said pod structures.

10. The spiral incremental construction of claim 9 wherein said vertical increment factor is calculated to produce a predetermined increase in vertical elevation per revolution about said core structure.

11. The spiral incremental structure of claim 10 wherein said vertical increment factor is in the range of 19.5 to 21.5 inches.

12. The spiral incremental structure of claim 10 wherein the outer periphery of said structure is hexagonal in configuration.

13. The spiral incremental structure of claim 12 wherein said core structure is hexagonal in configuration.

14. The spiral incremental structure of claim 11 wherein said pod structures are prefabricated modules including a floor assembly, radial wall assemblies, an exterior wall assembly, and a roof assembly.

15. The spiral incremental structure of claim 14 wherein said pod structures are generally diamond-shaped in configuration such that said radial wall assemblies within each pod structure define an included angle of 60 degrees.

16. The spiral incremental structure of claim 15 wherein adjacent pod structures are interconnected by removable fastening means.

17. A method of constructing a multilevel spiral incremental structure, said method comprising the steps of:

providing a plurality of prefabricated pod structures of a predetermined configuration;

constructing a stepped foundation wall about a central core structure at progressively higher elevations based upon a predetermined vertical increment factor;

installing said pods sequentially in symmetrical relation about said core structure at said progressively higher elevations;

repeating the above step of installing until one revolution is completed about said central core structure to construct an interim single level spiral structure.

18. The method of claim 17 further including the step of:

attaching additional pod structures sequentially in stacked vertical relation to said single level spiral structure to produce a multilevel spiral incremental structure.

* * * * *